United States Patent [19]

Brockman

[11] 4,184,260

[45] Jan. 22, 1980

[54] PATTERN FITTING SYSTEM AND METHOD

[75] Inventor: Helen L. Brockman, Manhattan, Kans.

[73] Assignee: Kansas State University Research Foundation, Manhattan, Kans.

[21] Appl. No.: 932,540

[22] Filed: Aug. 10, 1978

[51] Int. Cl.[2] ..... A41H 1/02; A41H 1/10

[52] U.S. Cl. ..... 33/15; 33/17 R

[58] Field of Search ..... 33/15, 2 R, 14, 11, 33/16, 12 R, 175, 17 R

[56] References Cited

U.S. PATENT DOCUMENTS 1,222,012 4/1917 Meas ..... 33/15

2,150,305 3/1939 Welch ..... 33/15

*Primary Examiner*—Willis Little

*Attorney, Agent, or Firm*—Tilton, Fallon, Lungmus & Chestnut

[57] ABSTRACT

A system in which a plurality of members or guides are applied in sequence and utilized in combination for aiding in the selection and/or modification of the paper patterns used for making garments. The system includes shoulder seam defining members, a back pattern size indicating member, and shoulder slope indicating members, all of which are used to establish those dimensions and relationships found to be critical in such selection and/or modification of garment patterns.

25 Claims, 12 Drawing Figures

FIG. 1
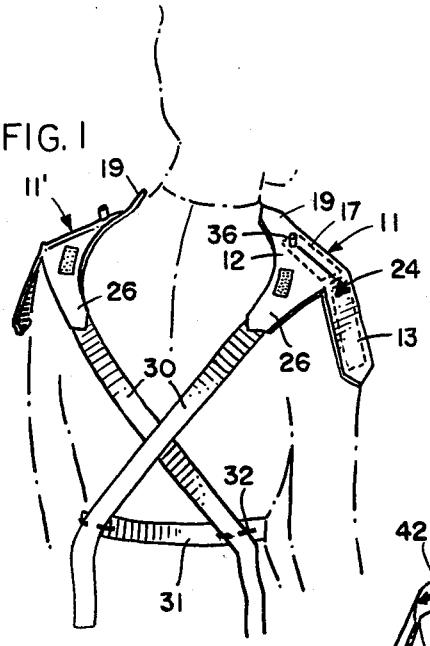
FIG. 2
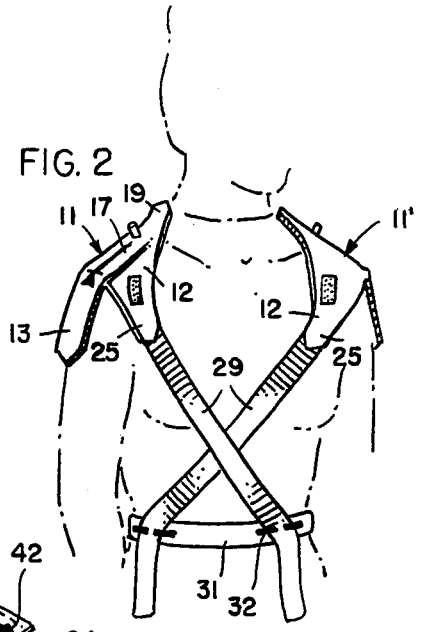
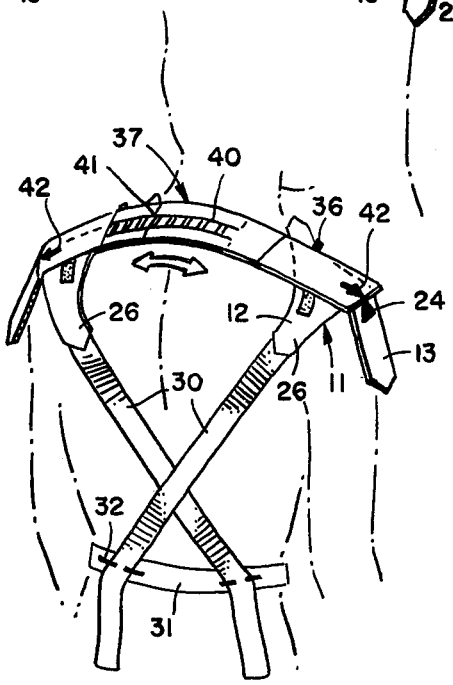
FIG. 4
FIG. 3
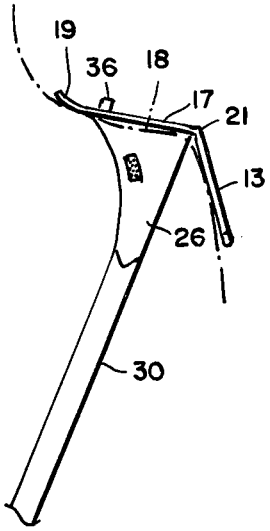
FIG. 5
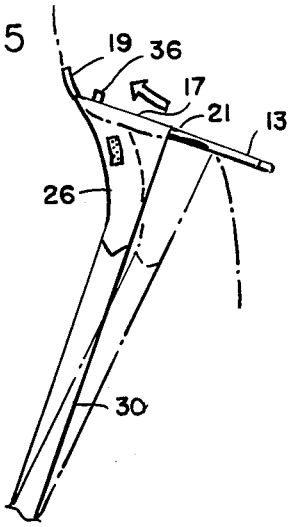

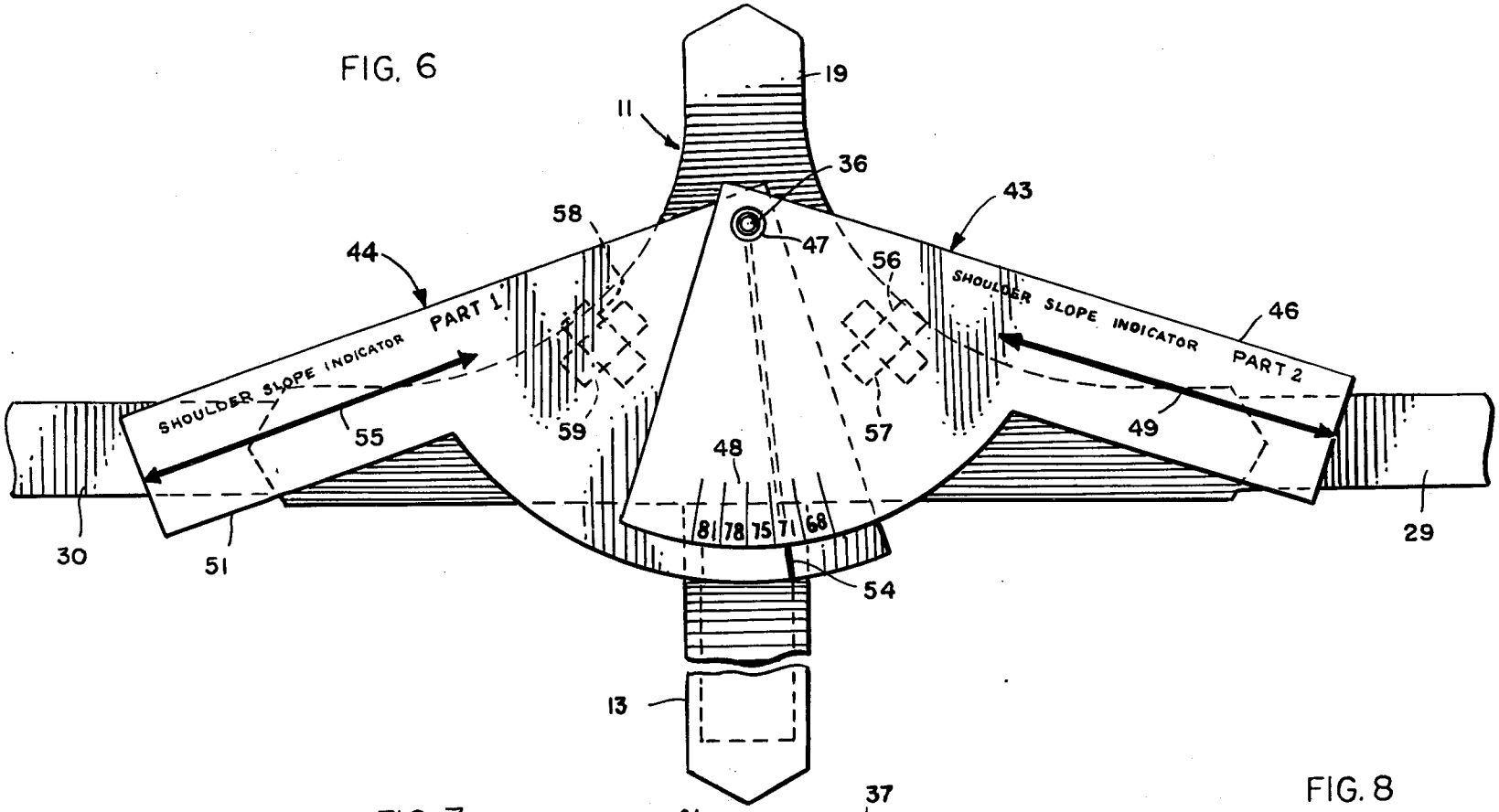
FIG. 6
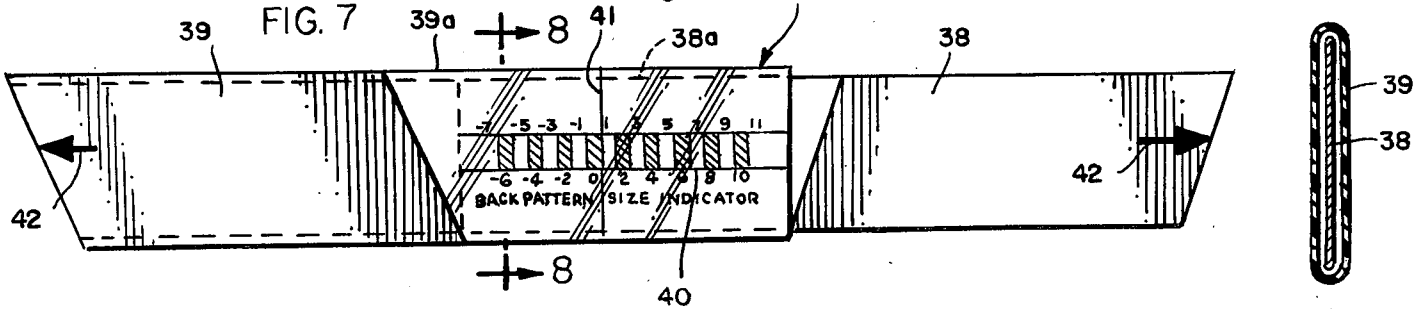
FIG. 7
FIG. 8

81
78
75
73
71
68

PATTERN FITTING SYSTEM AND METHOD

BACKGROUND

Paper patterns commercially available for use in the making and fitting of custom clothing, particularly womens' clothing, are generally standardized as to shapes and sizes and are not well suited for the fitting of clothing on figures which do not correspond closely with such standards. Minor deviations can of course be accommodated simply by seam adjustments but such adjustments are often insufficient to correct for greater deviations from the normal or standard sizes.

Some of these problems, and certain efforts to reduce them, are disclosed in U.S. Pat. No. 3,883,955. Other patents of interest concerned with the fitting of garments are U.S. Pat. Nos. 2,150,305, 3,559,289, 1,268,084, and 534,347.

SUMMARY OF INVENTION

One aspect of this invention lies in the discovery that while body dimensions depend both on bone structure and flesh development, there are no close correlations between the two and, therefore, conventional pattern designs which are standardized according to size without distinguishing the factors which affect size may result more often than not in poorly fitting garments even after seam alterations have been made. For example, it has been found that body width at the shoulder, which depends primarily on bone structure, has no stable relationship to chestline girth which depends largely on flesh development. Therefore, an object of this invention is to provide a system which is based on recognizing the existence of the different factors affecting size differences in the human structure and which involves devices or guides for taking those measurements by which standard garment patterns may be selected and adjusted, if necessary, or by which suitable patterns of a pattern module system based on such measurements may be established, selected, and combined.

The system involves the use of shoulder seam defining members which are fitted upon a user for precisely determining the proper shoulder seam locations for a bodice, a back pattern size indicating member which establishes the distance across the back from one shoulder seam to the other, and shoulder slope indicating members which coact with the seam defining members to establish the slope of the individual's shoulders. Such measurements, combined with other standard measurements such as arm girth, chestline girth, and back body length, may then be combined in the selection of the proper pattern modules for a properly-fitting bodice pattern for that individual. Alternatively, such information may be used, with suitable conversion information, for the purpose of modifying standard patterns. In either case, the devices or guide members of the system are used to achieve a combination of pattern elements customized for the individual.

Each of the shoulder seam defining members is formed primarily of sheet material, such as plastic or cloth, and has a body portion and a shoulder flap portion. The body portion has a stiff elongated central section adapted to extend along the ridge of a wearer's shoulder and a pair of flexible front and rear wing sections adapted to fold downwardly over the front and rear aspects of that shoulder. Straps are connected to the wing sections for securing each of the shoulder seam defining members in place, the straps being secured, preferably in an arrangement which crosses the wearer's front and back, to a suitable waistband.

The shoulder flap of each shoulder seam defining member is relatively stiff, elongated, and hingedly connected to the body portion along a hinge line which is adapted to be positioned at the outer limits of a subject's shoulder. An indicator mark is provided by the body portion adjacent the hinge line to serve as a clear indicator of seam location.

The shoulder seam indicating members provide a base or reference for determinations utilizing the back pattern size indicator and the shoulder slope indicating members. The back pattern size indicator comprises a pair of elongated inner and outer telescoping sections, the outer section having a transparent portion revealing that part of the inner section which is telescoped therein. The telescoping sections have free outer ends alignable with the indicia of the shoulder seam defining members and also have a visible scale—to indicate the back pattern size of the user.

Each shoulder seam defining member has an upstanding pivot element disposed adjacent the neck of the user when the members are properly secured in place. The pivot element or post of each seam defining member provides support for the pair of shoulder slope indicating members also formed of flexible sheet material. The two shoulder slope defining members are pivoted until integral tongue portions provided thereby extend vertically downwardly at the back and front of the wearer. The extent of overlap of the slope indicating members, as revealed by a scale and reference markings on such members, serves as a direct indication of the angle of shoulder slope. Friction holding elements help to maintain the shoulder slope indicating members in their final positions of adjustment, in snug surface engagement with the shoulder seam defining member disposed therebeneath, so that shoulder slope may be accurately measured.

The shoulder seam defining members are attached by means of straps in such a way that they may be adjusted inwardly and outwardly along the ridges of a wearer's shoulders while at the same time being firmly secured against forward or rearward displacement upon the shoulders. When back pattern size is to be determined, the shoulder seam defining members are adjusted outwardly until the relatively rigid flaps of those members project downwardly along the wearer's arms. Thereafter, prior to determining shoulder slope, the shoulder seam defining members are shifted inwardly towards the wearer's neck, thereby causing the flap portions to lift upwardly and the pivot post of each shoulder seam defining member to be positioned in close proximity to the neck. Such adjustment, as a preliminary step for the use of the shoulder slope indicating members, may be made without loosening the straps which hold the shoulder seam defining members upon the subject's shoulders.

Other features, objects, and advantages of the invention will become apparent from the specification and drawings.

DRAWINGS

FIG. 1 is a rear perspective view showing the shoulder seam defining members in place upon a wearer's shoulders.

FIG. 2 is a front perspective view otherwise similar to FIG. 1.

FIG. 3 is a fragmentary view illustrating the proper positioning of a shoulder seam defining member for the purpose of shoulder seam measurement.

FIG. 4 is a perspective view similar to FIG. 1 but showing the back pattern size indicating member used in conjunction with the shoulder seam defining members.

FIG. 5 is a fragmentary view similar to FIG. 3 but showing a shoulder seam defining member shifted inwardly towards a wearer's neck for the purpose of measuring shoulder slope.

FIG. 6 is a fragmentary plan view of a shoulder seam defining member with a pair of shoulder slope indicating members pivotally coupled thereto.

FIG. 7 is a plan view of the back pattern size indicating member.

FIG. 8 is an enlarged cross sectional view taken along line 8—8 of FIG. 7.

DETAILED DESCRIPTION

Figures 9, 10, 11, 12:
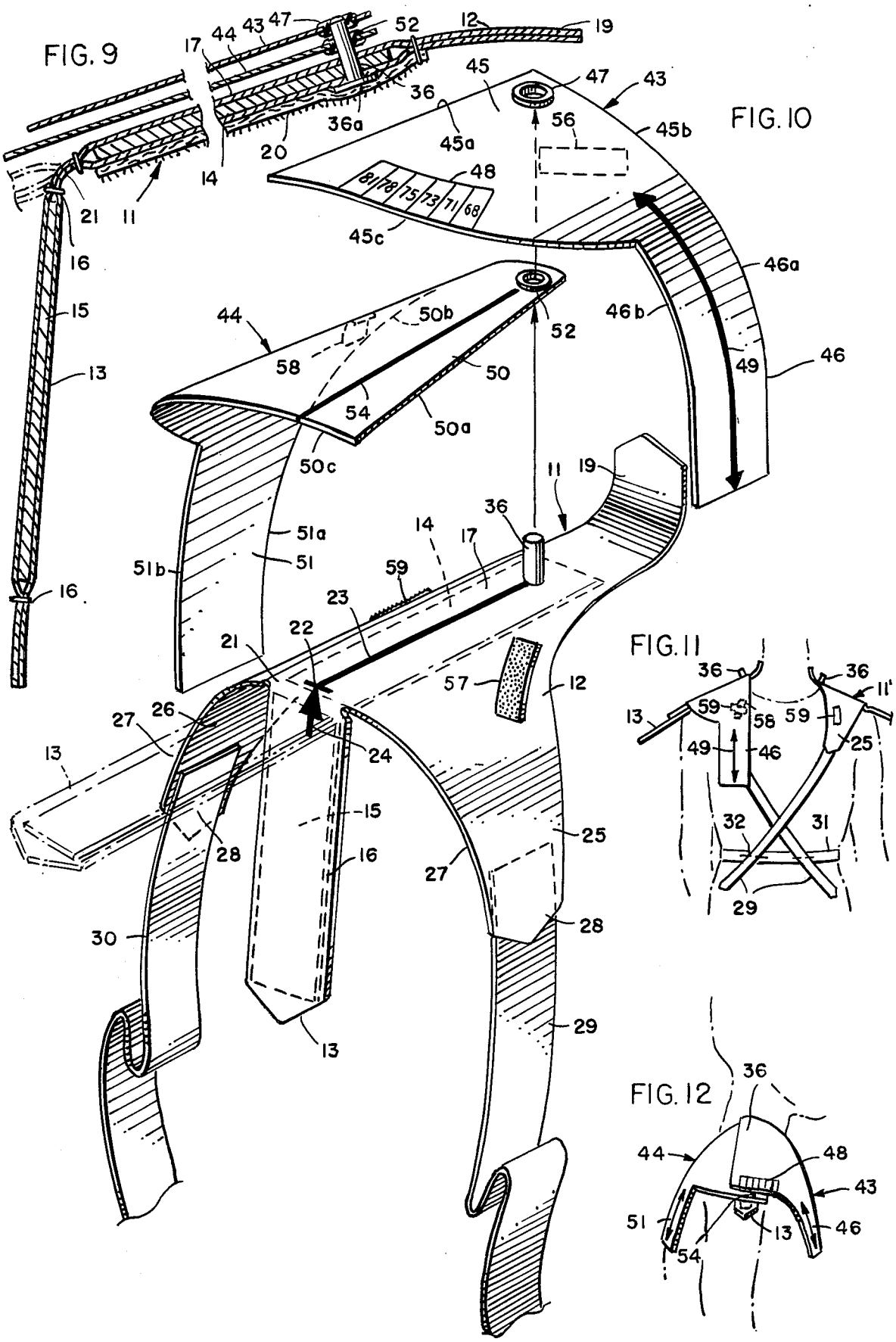
FIG. 9 is an enlarged sectional view illustrating the cooperative relationship between the shoulder slope indicating members and a shoulder seam defining member.
FIG. 10 is an exploded perspective view depicting the relationship between a shoulder seam defining member and a pair of shoulder slope indicating members.
FIG. 11 is a front view showing the shoulder slope indicating members in use.
FIG. 12 is a side view of the shoulder slope indicating members in use in the manner depicted in FIG. 11.

Referring particularly to FIGS. 1, 2, 9 and 10, the numerals 11 and 11' generally designate a pair of shoulder seam defining members adapted to be fitted upon a user's shoulders in the manner illustrated. The two members are the same to the extent that they are mirror images of each other; hence, a description of one is applicable to both. Each member 11 (or 11') has a body portion 12 and a shoulder flap portion 13. Both portions are formed primarily of flexible sheet material, preferably a suitable plastic material such as a flexible vinyl polymer which is durable, soil resistant, and easily cleaned, although other flexible sheet materials such as cloth may be used, and, if desired, a double thickness of such sheet material may be used as shown (FIG. 9). The advantage of using double thickness is that stiffening elements 14 and 15 may be sandwiched and concealed between the two layers as shown. However, it is believed apparent that the flexible material may instead be of only single thickness with the stiffening elements secured to one side or the other by stitching, adhesives, or other suitable means.

Stiffening element 15 extends substantially the full length of flap portion 13 and may be held in place by stitching 16. The stiffening member 14 is disposed within the elongated central section 17 of body 12 and is disposed in end-to-end alignment with the flap portion when that portion is raised as indicated in broken lines in FIG. 10. The stiff elongated central section is adapted to extend along and rest upon the ridge of a user's shoulder as indicated most clearly in FIGS. 1, 2 and 3. It is to be noted that the length of the stiffened and elongated central section is substantially the same, or slightly less, than the shortest ridge length of a shoulder upon which the member is intended to be supported. Because of its stiffened construction, the central section 17 is therefore long enough to bridge a concavity along the shoulder ridge of a user (note concavity or dip 18 in FIG. 3) without at the same time exceeding the length (width) of the shoulder.

The body portion 12 of each shoulder seam defining member 11 may include a flexible tab 19 which is aligned with the stiffened central section 17 at the end of that section opposite from flap portion 13. The tab performs the dual functions of increasing user comfort, by providing a flexible extension of stiffened section 17, and of serving as a pointer or indicator to assist in proper orientation of the shoulder seam defining member. As shown most clearly in FIG. 10, the tab 19 is tapered to a rounded point to aid in the positioning of member 11 along the ridge of a user's shoulder. User comfort may also be increased by stitching or otherwise securing a strip of soft fabric 20 along the underside of central section 17 as depicted in FIG. 9. Such a strip will also increase the ease of use by increasing the friction between the piece and the user's body or clothing.

The rigid central section 17 and flap portion 13 are joined by an integral transverse hinge 21 which permits the flap portion to be shifted between the lowered and raised positions illustrated in solid and broken lines in FIGS. 9 and 10. At the outer limit of the stiff central section, just inboard of hinge 21, is a transversely extending indicia mark 22. In addition, a second indicia marking in the form of longitudinal line 23 extends along the longitudinal mid line of elongated central section 17 and intersects with transverse line 22. The two lines may be imprinted upon or otherwise secured to the top surface of section 17. Line 23 is useful in properly orienting member 11 so that its stiffened central section 17 extends along the ridge of the user's shoulder. Transverse line 22 represents the proper shoulder seam location for a garment to be fitted upon the user and, since that line might under some circumstances be momentarily concealed by the shoulder pattern size indicator, an additional marking in the form of arrow 24 may be applied to flap portion 13 and hinged 21 just outboard of line 22.

The body portion 12 of shoulder seam defining member 11 also has a pair of flexible flap or wing sections 25 and 26 which have outer edges 27 in general transverse alignment with hinge 21 and which taper away from central section 17, terminating in ends 28 of reduced width. Straps 29 and 30 are secured to the ends of wing sections 25 and 26. It is believed apparent that the straps may instead be formed integrally with the wing sections if such a construction is considered desirable. The straps are of sufficient length to extend downwardly beyond a waistband or belt 31 fitted snugly about the user's waist. Attachment means in the form of pins 32 are used for temporarily but securely attaching the straps to the waistband as shown in FIGS. 1-3. Other types of well known attachment means might instead be used; for example, the nylon hook and loop components currently marketed under the Velcro trademark may be effectively used with one of such components being secured to the outer surface of waistband or belt 31 and the other of such components being secured to the inwardly-facing surfaces of straps 29 and 30.

A pivot element in the form of upstanding post 33 is secured to the member 11 adjacent that end of rigid central section 17 remote from flap portion 13 (FIGS. 9 and 10). The post may have an enlarged head 36*a* concealed above lining 20 as shown in FIG. 9.

The back pattern size indicating member 37 is illustrated most clearly in FIGS. 7 and 8 and takes the form of a pair of telescoping sections 38 and 39. One end 38*a* of planar inner section 38 is received within a transparent end portion 39*a* of tubular outer section 39. A scale 40 is imprinted or otherwise applied to one of the end portions and a reference mark 41 is applied to the other, such indicia serving to indicate the telescoping relationship of the parts and preferably being calibrated in terms of back pattern sizes or other suitable measurements. The free outer ends of the respective sections are provided with arrow markings 42.

Shoulder slope indicating members 43 and 44, and their relationship to shoulder seam defining member 12, are illustrated most clearly in FIGS. 6, 9, and 10. The upper member is formed of flexible sheet material of the type already described and has a sector-shaped main portion 45 and an elongated or linear tongue portion 46. The sector-shaped main portion has a pair of radial edges 45*a* and 45*b* and an arcuate edge 45*c*. One of the straight edges 46*a* of the tongue is aligned with radial edge 45*b* and forms a continuation of the latter; the other longitudinal edge 46*b* of the elongated tongue is parallel with edge 46*a* and merges with arcuate edge 45*c*. Coupling means in the form of a grommet 47 having an opening large enough to receive post 36 is located in the apical zone of the sector-shaped main portion 45. A series of indicia 48 representative of the slope of the shoulder are applied to member 43 along arcuate edge 45*c*. Tongue 46 may be imprinted with a guide line 49, the line preferably being parallel with edges 46*a* and 46*b*.

Member 44 is similar to member 43 except for differences in size, orientation, and marking. Like member 43, member 44 has a sector-shaped main portion 50 defined by radial edges 50*a* and 50*b* and by arcuate edge 50*c*. An elongated tongue portion 51 is formed integrally with the sector-shaped portion and has a pair of parallel longitudinal edges 51*a* and 51*b*, the former being a linear continuation of edge 50*b* and the latter merging with arcuate edge 50*c*. The apical zone of sector-shaped portion 50 is provided with a grommet 52 which also is capable of receiving post 36.

The lower member 44 differs from the upper member to the extent that the radial dimension of the sector-shaped portion 50 is greater than the radial dimension of sector-shaped portion 45. Therefore, when the parts are superimposed as shown in FIG. 6, both members being pivotally mounted on the same pivot element or post 36, the sector-shaped portion of the lower member projects radially beyond the upper member. A radially-extending reference line 54 imprinted or otherwise applied to the sector-shaped section 50 therefore extends beyond the radial limits of section 45 so that an appropriate reading from scale 48 may be taken. Like the upper member, lower member 44 may have a line 55 applied to the surface of tongue 51 and extending in parallel relation with respect to the longitudinal edges of that tongue.

Means are provided by the shoulder slope indicating members and each shoulder seam defining member for holding such components in selected positions of adjustment when a shoulder slope measurement is to be taken. Such means takes the form of patches of material having interlocking nylon loops and hooks disposed along the opposing surfaces of member 11 (or 11') and members 43 and 44. As already indicated, such patches may be formed of a material available under the Velcro trademark. Patch 56 along the underside of sector-shaped portion 45 of member 43 is opposed by and adapted to frictionally interlock with patch 57 along the top surface of the wing section 25 of shoulder seam defining member 11, whereas patch 58 along the underside of member 44 is adapted to interconnect with patch 59 along the top surface of wing section 26. The patches of each pair are oriented so that interlocking contact with be made throughout the full range of shoulder slopes which the members 43 and 44 are adapted to measure. In addition to securing the overlapping members in selected positions of adjustment, the interconnecting patches also insure that the opposing surfaces of such members are indeed in mutual surface engagement—that is, that there are no bulges or folds which might, if undetected, give rise to false readings.

The operation of the system involves first placing the shoulder seam defining members upon a user's shoulders as indicated in FIGS. 1 and 2, making sure to adjust such members so that their stiff central sections 17 extend along the ridges of the individual's shoulders, hinges 21 are at the points of the shoulders with the hinge lines extending horizontally, and flap portions 13 extend downwardly in surface contact with the user's upper arms (FIG. 3). Straps 29 and 30 are secured to waistband 31 as shown, the straps being drawn snugly to hold the shoulder seam defining members 11 and 11' against forward or rearward displacement upon the wearer's shoulders. Since the straps extend at generally right angles to the longitudinal mid line of the stiff elongated central portion 17 of each shoulder seam defining member, drawing the straps 29 and 30 taut urges the central sections into firm engagement with the user's shoulders and holds members 11 and 11' against forward/rearward displacement without at the same time preventing limited adjustment of the members along the ridges of the shoulders for the purpose of precisely orienting such members as shown in FIG. 3. The stiffness of central section 17 is important in bridging concave shoulder configurations, whereas the stiffness of flap portions 13 is essential for the purpose of accurately positioning each member as illustrated.

The crossing of straps 30 and 29 at the back and front, respectively, has an additional significance. Ideally, the crossing of straps 30 should occur along the vertical centerline of the user's back and the crossing of straps 29 should take place along the vertical centerline of the chest. Such a relationship will occur, however, only when both shoulders have the same degree of slope. While lack of symmetry will have no effect on the working properties of the shoulder seam defining members, it would serve as a signal to the fact that the slope of the two shoulders is probably not the same.

With the shoulder seam defining members positioned as shown in FIGS. 1–3, the back pattern size indicating member 37 is placed across the subject's back and is extended or retracted so that the ends of that member are precisely aligned with transverse indicator lines 22 of the shoulder seam defining members. The points of arrows 24 and 42 should be in direct opposition as shown in FIG. 4. A reading is then taken from scale 40 and reference line 41 to establish the back width at the shoulder seams, and hence the size of the back pattern, to be used in the fitting of patterns upon the user.

Thereafter, member 37 is removed and the shoulder seam defining members 11 and 11' are shifted inwardly and upwardly along the ridges of the shoulders into the positions depicted in FIGS. 5, 11, and 12. Tabs 19 extend upwardly along the sides of the neck, flap portions 13 are raised, and the stiff and central sections 17 bridge any dips or depressions 18 in the shoulder to assume angular positions which represent the preferred slope to be used in selecting or modifying patterns for the individual involved. Such shifting movement as indicated in FIG. 5 is achieved without altering the attachments between straps 29 and 30 on one hand and waistband 31 on the other. The straps therefore guide movement of the shoulder seam defining members between the two positions illustrated.

When the shoulder seam defining members 11 and 11' are in their raised positions of FIG. 5, pivot posts 36 are positioned as close as possible to the user's neck. The shoulder slope indicating members 43 and 44 are then fitted upon one of the posts in the relationship illustrated in FIGS. 9–12. Lower member 44 is first positioned so that grommet 52 receives post 36 and guide line 55 of tongue 51 (FIG. 6) extends vertically. The upper member 43 is then placed upon the post and is similarly oriented so that guide line 49 of tongue 46 is vertically oriented (FIG. 11). The Velcro patches secure the shoulder slope indicating members 43 and 44 in their positions of adjustment while a shoulder slope reading is taken from scale 48 and reference line 54 (FIG. 12). The shoulder slope indicating members are then removed and are positioned upon the post 36 of the other shoulder seam defining member for the purpose of determining the slope of the user's other shoulder.

It is believed apparent that the above description of this system does not detail many of the conventional measuring steps which would be carried out in fitting patterns. The actual selecting and/or adjusting of patterns, in order to obtain a combination of pattern elements or modules which might then be used in making garments customized for a given individual are beyond the scope of this invention and would unduly extend this disclosure if presented here. It is believed sufficient to point out that the measurements achieved through the use of the devices and methods described above are critical parameters in the selecting or adjusting of patterns for the custom fitting and tailoring of clothing.

While in the foregoing I have disclosed embodiments of the invention in considerable detail for purposes of illustration, it will be understood that many of these details may be varied without departing from the spirit and scope of the invention.

I claim:

1. A system for use in the selecting and/or modifying of patterns for the fitting of clothing to a human figure, comprising a pair of shoulder seam defining members each having a body portion and a flap portion; said body portion having a stiff elongated central section adapted to extend along and rest upon the ridge of a subject's shoulder and having a pair of flexible front and rear wing sections adapted to fold downwardly over and conform generally with the respective front and rear surfaces of the subject's shoulder; means connected to said wing sections for securing both of said shoulder seam defining members in place upon a subject's shoulders; said flap portion of each member being stiff, elongated, and hingedly joined at one end to said body portion along a transverse hinge line adapted to be positioned at the outer limit of a subject's shoulder; each flap portion being adapted to hang downwardly against a subject's upper arm to direct the location of said hinge line at said outer limit of the subject's shoulder; and indicia means provided by each of said members adjacent the hinge line thereof.

2. The system of claim 1 wherein said means for securing said members in place comprises a plurality of straps each affixed at one end to a wing section and adapted to be secured at the other end thereof to a subject's waist.

3. The system of claim 2 in which said means includes a waistband adapted to extend about a subject's waist; and connecting means for detachably and adjustably securing said waistband and straps together.

4. The system of claim 1 in which said indicia means comprises a linear marking upon each central section; said linear marking being disposed in spaced parallel relation with respect to said hinge line.

5. The system of claim 1 in which second indicia means is provided by each of said members; said second indicia means comprising a linear marking upon each central section extending longitudinally thereof.

6. The system of claims 1, 2, or 4 in which said system includes a back pattern size indicating member having a pair of elongated inner and outer telescoping sections; said outer section having a transparent portion revealing the portion of said inner section telescopingly received therein; said telescoping section having free outer ends alignable with the indicia means of said shoulder seam defining members when said shoulder seam defining members are fitted upon a subject; and visible scale markings provided by said inner and outer sections to indicate the condition of telescoping adjustment of said sections.

7. The system of claim 6 in which each central section of said shoulder seam defining members is provided with an upstanding pivot element secured thereto and disposed adjacent the end of said section remote from said flap portion; and a pair of shoulder slope indicating members formed of flexible sheet material and each equipped with coupling means engagable with the pivot elements of said shoulder seam defining members; said shoulder slope indicating members each having a sector-shaped main portion provided with a pair of radial edges diverging from an apical zone to an arcuate edge and an elongated tongue portion extending beyond said arcuate edge in a direction parallel with one of said radial edges; said coupling means of each of said shoulder slope indicating members being located in said apical zone; and indicia provided by at least one of said shoulder slope indicating members adjacent the arcuate edge thereof for indicating the extent of overlap of said sector-shaped portions, and hence the slope of a wearer's shoulder, when said members are pivotally coupled to one of said pivot elements and said tongue portions are adjusted and positioned to hang vertically from the front and rear of a wearer's shoulder.

8. The system of claim 7 in which the sector-shaped portion of one of said shoulder slope indicating members has a radial dimension greater than the sector-shaped portion of the other of said members and is adapted to be interposed between said one member and a shoulder seam defining member when both of said shoulder slope indicating members are connected to a pivot element.

9. The system of claim 8 in which said indicia of said shoulder slope indicating members comprises one of said members having a series of slope-indicating indicia extending along the arcuate edge thereof and the other of said members having an index mark registrable with the indicia of said series.

10. The system of claim 9 in which said tongue portion of said shoulder slope indicating members are provided with linear indicia thereon to assist in positioning said tongue portions into vertical positions of adjustment.

11. The system of claim 7 in which releasable connecting means are provided along the opposing surfaces of said wing sections and said sector-shaped portions for holding said shoulder slope indicating members upon a shoulder seam defining member in selected positions of adjustment.

12. A system for use in the selecting and/or modifying of patterns for the fitting of clothing to a human figure, comprising a pair of shoulder seam defining members each having a body portion and a flap portion; said body portion having a stiff elongated central section adapted to extend along and rest upon the ridge of a subject's shoulder and having a pair of flexible front and rear wing sections adapted to fold downwardly over and conform generally with the respective front and rear surfaces of the subject's shoulder; means connected to said wing sections for securing both of said shoulder seam defining members in place upon a subject's shoulders; said flap portion of each member being stiff, elongated, and hingedly joined at one end to said body portion along a transverse hinge line adapted to be positioned at the outer limit of a subject's shoulder; indicia means provided by each of said members adjacent the hinge line thereof; each central section of said shoulder seam defining members being provided with an upstanding pivot element secured thereto and disposed adjacent the end of said central section remote from said flap portion; and a pair of first and second shoulder slope indicating members formed of flexible sheet material and each equipped with coupling means engagable with the pivot elements of said shoulder seam defining members; said shoulder slope indicating members each having a sector-shaped portion provided with a pair of radial edges diverging from an apical zone to an arcuate edge and an elongated tongue portion extending beyond said arcuate edge in a direction parallel with one of said radial edges; said coupling means of each of said first and second members being located in said apical zone; and angle-measuring indicia provided by at least one of said first and second members along the arcuate edge thereof for indicating the extent of overlap of said sector-shaped portions, and hence the slope of a wearer's shoulder, when said first and second members are pivotally coupled to one of said pivot elements and said tongue portions are adjusted and positioned to hang vertically from the front and rear of that shoulder.

13. The system of claim 12 in which the sector-shaped portion of said second member has a radial dimension greater than that of said first member and is adapted to be interposed between said first member and a shoulder seam defining member when said first and second members are connected to the pivot element of one of said shoulder seam defining members.

14. The system of claim 13 in which said indicia of said shoulder slope indicating members comprises one of said first and second members having a series of slope-indicating indicia extending along the arcuate edge thereof and the other of said first and second members having an index mark registrable with the indicia of said series.

15. The system of claim 12 in which said first and second members are provided with linear indicia parallel with said tongue portions for assisting in visually ascertaining when said tongue portions are vertically disposed.

16. The system of claim 12 in which said means for securing said members in place comprises a plurality of straps each affixed at one end to a wing portion and adapted to be secured at the other end thereof to a waistband extending about a subject's waist.

17. The system of claim 16 in which said means includes a waistband adapted to extend about a subject's waist; and connecting means for detachably and adjustably securing said waistband and straps together.

18. The system of claim 12 in which said indicia means comprises a linear marking upon each central section; said linear marking being disposed in spaced parallel relation with respect to said hinge line.

19. The system of claim 12 in which second indicia means is provided by each of said shoulder seam defining members; said second indicia means comprising a linear marking upon each central section extending along the length thereof.

20. A method for use in selecting and/or modifying clothing patterns for a human subject, comprising the steps of adjusting a pair of shoulder seam defining members upon the shoulders of a human subject, each member having a body portion with a stiff elongated central section and having a stiff flap portion hingedly joined to said body portion at one end of said elongated central section, said stiff elongated central section of each member having an upstanding pivot element adjacent one end thereof and having an indicia mark adjacent the opposite end thereof, said adjusting step including positioning said members until said stiff central sections extend along the ridges of the subject's shoulders and said flaps extend downwardly in contact with the subject's arms just beyond said shoulders, temporarily restraining said members against movement out of said positions of adjustment, then measuring the distance between said indicia of said pair of members across the subject's back, and thereafter pivotally supporting a pair of shoulder slope indicating members from the pivot element of each shoulder seam defining member and pivotally adjusting said shoulder slope indicating members to measure the slope of each of the subject's shoulders.

21. The method of claim 20 in which said restraining step comprises fixing each of said shoulder seam defining members against movement in directions transverse to the elongated central section thereof while at the same time permitting limited movement of each of said shoulder seam defining members in directions parallel with the length of said central sections.

22. The method of claim 21 in which said shoulder seam defining members are each provided with a front strap and a rear strap joined to said body portion, said restraining step comprising extending both of said rear straps downwardly over the subject's back and securing the lower ends thereof to the rear portion of a band extending about a wearer's waist, and extending the front straps over the subject's chest and securing the lower ends thereof to the front portion of said band.

23. The method of claim 22 in which the rear strap of the respective members cross over the vertical mid line of the subject's back and said front straps cross over the vertical mid line of the subject's chest.

24. The method of claim 21 in which each central section is substantially shorter than the ridge length of a subject's shoulder and in which there is the additional step of shifting each of said shoulder seam defining members inwardly to displace said pivot element closer to the subject's neck after said measuring step has taken place and before said step of pivotally supporting said shoulder slope indicating members has occurred.

25. The method of claim 20 in which there is the further step of frictionally and releasably securing said shoulder slope indicating members to the flap portions of each shoulder seam defining member to anchor said shoulder slope indicating members against pivotal movement prior to measuring the slope of a subject's shoulder.

* * * * *